United States Patent [19]

Edelman et al.

[11] 4,168,989

[45] Sep. 25, 1979

[54] STRIPPING COMPOSITION FOR THERMOSET RESINS AND METHOD OF REPAIRING ELECTRICAL APPARATUS

[75] Inventors: Leonard E. Edelman, Penn Hills Township, Allegheny County; Gerhard R. Sprengling, Derry Township, Westmoreland County; Louis A. Cargnel, Unity Township, Westmoreland County, all of Pa.

[73] Assignee: Westinghouse Electric Corp., Pittsburgh, Pa.

[21] Appl. No.: 790,229

[22] Filed: Apr. 25, 1977

Related U.S. Application Data

[63] Continuation of Ser. No. 585,733, Jun. 10, 1975, abandoned.

[51] Int. Cl.[2] ..... B08B 3/08; C11D 7/26; C11D 7/32; C11D 7/50

[52] U.S. Cl. ..... 134/28; 134/30; 134/38; 252/143; 252/170; 252/171; 252/546

[58] Field of Search ..... 134/28, 29, 30, 38; 252/117, 118, 122, 546, DIG. 8, 170, 171, 143

[56] References Cited

U.S. PATENT DOCUMENTS

| | | | |
|---|---|---|---|
| 2,242,106 | 5/1941 | Buckman | 134/38 X |
| 2,398,242 | 4/1946 | Morgan et al. | 252/118 |
| 2,443,173 | 6/1948 | Baum et al. | 252/DIG. 8 |
| 2,689,198 | 9/1954 | Judd | 134/38 X |
| 2,939,209 | 6/1960 | Schwartz | 134/38 X |
| 3,216,945 | 11/1965 | Mankowich | 252/DIG. 8 |
| 3,563,900 | 2/1971 | Murphy | 252/135 |
| 3,669,740 | 6/1972 | Yamamoto et al. | 252/142 X |
| 3,681,250 | 8/1972 | Murphy | 134/38 X |
| 3,813,343 | 5/1974 | Mukai et al. | 252/DIG. 8 |

OTHER PUBLICATIONS

*Hackh's Chem. Dictionary,* 1969, p. 580.

*Primary Examiner*—Marc L. Caroff
*Attorney, Agent, or Firm*—R. D. Fuerle

[57] ABSTRACT

A stripper composition for thermoset resins is disclosed which comprises about 1 to about 99% of an aromatic compound which has a boiling point over 180° C. and is a phenol or a primary or secondary amine, and about 1 to about 99% of a carboxylic acid compound which has a boiling point over 180° C. and is a rosin acid or a mono- or di-carboxylic fatty acid or an ester thereof. The composition also preferably includes sufficient hydrogen bonding compound to react with any acid present in the composition plus about 20 to about 50% in excess of that amount. A swelling agent is also preferably included.

25 Claims, 2 Drawing Figures

STRIPPING COMPOSITION FOR THERMOSET RESINS AND METHOD OF REPAIRING ELECTRICAL APPARATUS

This is a continuation of application Ser. No. 585,733, filed June 10, 1975, now abandoned.

BACKGROUND OF THE INVENTION

Defective motors are repaired by removing the conductor coils from the magnetic iron core and re-winding the core. The coils are, of course, insulated, and are usually held in place by varnish impregnant, wedges, and end blocks. This material, which consists largely of thermoset resins, must be removed or destroyed in order to remove the coils. The usual practice is to burn out the thermoset resins. Burning, however, produces pollutants, uses energy, and leaves a char which is difficult to remove.

An alternative procedure is to immerse the motor in a stripper composition. Commercial strippers, however, swell the resin without destroying it, and a swelled resin may be no easier to remove than an unswelled resin. Moreover, most strippers attack only one or only a few types of resins. Motors which are turned over to repair shops, however, may contain many different resins. The motor owner may not know what resins are in the motor nor can this information be readily ascertained. Therefore, there is no way of knowing which stripper composition, if any, will be effective on a given motor.

PRIOR ART

U.S. Pat. No. 3,669,740 discloses a composition for cleaning polyamide comprising at least 25% carboxylic acid such as oleic acid and a diluent such as polyethylene glycol.

U.S. Pat. No. 3,681,250 discloses a paint stripper comprising an alkaline material, ethylene glycol monophenyl ether, and a phenol such as B-naphthol.

U.S. Pat. No. 3,563,900 discloses a paint stripper comprising an aqueous dispersion of B-naphthol.

SUMMARY OF THE INVENTION

We have found a stripper composition which will destroy most thermoset resins, including epoxies, polyesters, phenolics, melamine, ureas, silicones, and acrylics. The only thermoset resins we have found which are not readily attacked by the stripper are diphenyl oxide polymers and aromatic polyimides and polyamide imides.

The stripper does not merely swell the resin, although a swelling agent is preferably included in the composition to render the resin more accessible to attack, but rather it attacks the resin by breaking the polymers into smaller molecules which are soluble, whereas the polymer is not.

The stripper produces very little pollution since vapors are condensed and returned. It is apparently of low toxicity and does not attack common metals such as iron, copper, and aluminum, nor does it attack glass or cellulose. Also, it has no apparent effect on the interlaminar insulation of electrical equipment. It works rapidly, in most cases requiring only a few hours to strip a motor stator or rotor, and uses less energy than does burning the insulation. Also, although a batch of the stripper will last for some time, it can be renewed by the addition of ingredients used up in the stripping reaction or otherwise lost.

DESCRIPTION OF THE INVENTION

Figure 1:
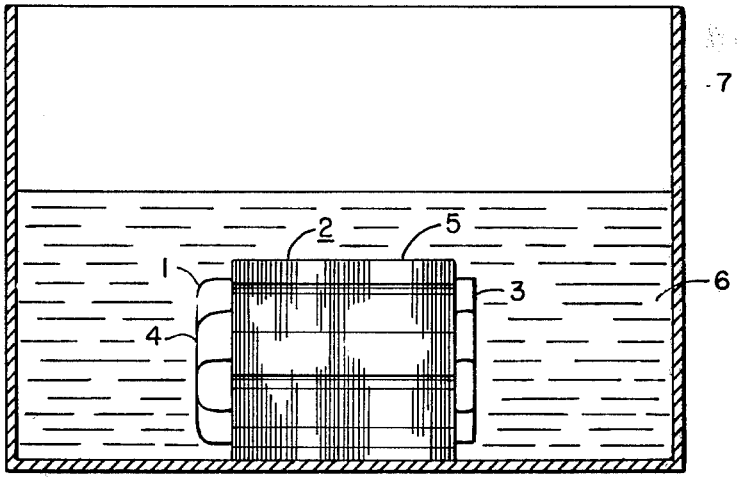
FIG. 1 is a cross-sectional view of a motor stator immersed in a composition according to this invention.

The composition of this invention comprises a reactive component of about 1 to about 99% (all percentages herein are by weight based on the reactive component) of an aromatic compound and about 1 to about 99% of a carboxylic acid compound. Preferably, for a more reactive composition, the amount of aromatic compound is about 10 to about 50% and the amount of carboxylic acid compound is about 50 to about 90%.

The aromatic compound is a phenol or a primary or secondary amine which has a boiling point over 180° C., and preferably over 250° C. The amine or hydroxy group must be on an aromatic ring since aliphatic compounds such as urea and guanidine do not work on a wide range of thermoset resins. In the secondary amine group, —NHR, the R group may be alkyl to $C_4$. Primary amines are preferred to secondary amines because primary amines are more active and less expensive. Phenols, however, are preferred to amines because amines are more expensive and more toxic. Examples of suitable aromatic compounds include $\beta$-naphthol, $\alpha$-naphthol, m-phenylene diamine, aniline, resorcinol, hydroquinone, cresol, catechol, and p-phenyl phenol. Resorcinol and $\beta$-naphthol are preferred because they are among the most active compounds in attacking resins. Mixtures of aromatic compounds are also contemplated.

The carboxylic acid compound is a carboxylic acid which has a boiling point over 180° C. and preferably over 250° C. Esters of the acids may also be used. The carboxylic acid can be aliphatic, alicyclic, or aromatic. Rosin acids and fatty acids are preferred because they have low volatility and are readily available at a low cost. Mono-carboxylic fatty acids are preferred to di-carboxylic fatty acids because they are less expensive. Saturated or mono-saturated fatty acids are preferred to di- or poly-unsaturated fatty acids because the latter may oxidize. Examples of suitable carboxylic acid compounds include linseed fatty acid, tall oil, and tall pitch. Tall pitch is preferred because it is less expensive and more active because it contains swelling agents. Tall pitch is a by-product of tall oil refining and is commonly a complex mixture of about 20 to about 50% fatty acids, principally oleic acid, about 20 to about 50% rosin acids, principally abietic acid, and about 20 to about 50% neutral unsaponifiable compounds. Tall oil is a by-product of paper manufacture and is similar in composition to tall pitch but has less neutral unsaponifiable material and more rosin and fatty acids. Mixtures of fatty acids and rosin acids may also be used.

The composition also preferably includes enough of a hydrogen bonding compound to react with any acid which may be present plus an excess of about 20 to about 50 phr (parts by weight per 100 parts of the reactive component). The purposes of the hydrogen bonding compound are to retard the evaporation of the aromatic compound and attack resins being stripped. The hydrogen bonding compound has at least one unshared electron pair capable of entering into a hydrogen bond with the amine or hydroxyl group of the aromatic compound. The hydrogen bonding compound has a boiling point over 180° C. and preferably over 250° C. Quinoline and its derivatives may be used, but hydroxyl compounds are preferred because they are less expensive.

The hydroxyl compound should have non-vicinal hydroxyl groups as compounds with vicinal hydroxyl groups, such as glycerol, do not work as well. Examples of suitable hydrogen bonding compounds include triethylene glycol (TEG), polypropylene glycol, quinoline, and polyethylene glycol. TEG or a mixture of high boiling glycols is preferred as they are the most effective. Mixtures of hydrogen bonding compounds are also contemplated.

The composition preferably includes up to about 50 phr of a swelling agent. The preferred amount of swelling agent which gives the most effective results is about 5 to about 30 phr. The function of the swelling agent is to loosen the structure of the resins so that they can be more readily chemically attacked. The swelling agent is a solvent for the resin under attack in the resin's uncrosslinked state. A compound which dissolves an uncrosslinked resin will swell a crosslinked resin. The swelling agent has a boiling point over about 180° C. and preferably over 250° C. Examples include pine oil and terpenoid compounds. The preferred swelling agents, however, are the neutral unsaponifiable components of tall oil and tall pitch. Thus, the use of tall oil or tall pitch will automatically include a swelling agent. Mixtures of swelling agents are also contemplated.

The composition is prepared by simply mixing the ingredients in the proper proportions. The composition is then heated to about 180° C. to about 250° C. At temperatures lower than about 180° C. the stripping action requires too much time, although thin coatings such as paints can be stripped in a reasonable time at temperatures as low as 150° C. At temperatures over 250° C. evaporation becomes a problem. At all temperatures the vapors from the composition are passed through a condenser and the condensate is returned to minimize losses and reduce air pollution.

The object to be stripped is immersed into the composition until it has been observed to be stripped. If the object is a motor stator or rotor, it is first prepared by sawing off the ends of the coils. If the rotating apparatus is form wound it may not be necessary to cut the ends, but mesh wound apparatus must be cut at at least one end.

In FIG. 1 coils 1 of stator 2 have been cut at 3. The other end of the coils 4 has not been cut to provide something to grasp while pulling the coils from laminated core 5. The stator is immersed in stripping composition 6 held in tank 7. About 1 to about 6 hours is usually required to strip a motor coil.

Figure 2:
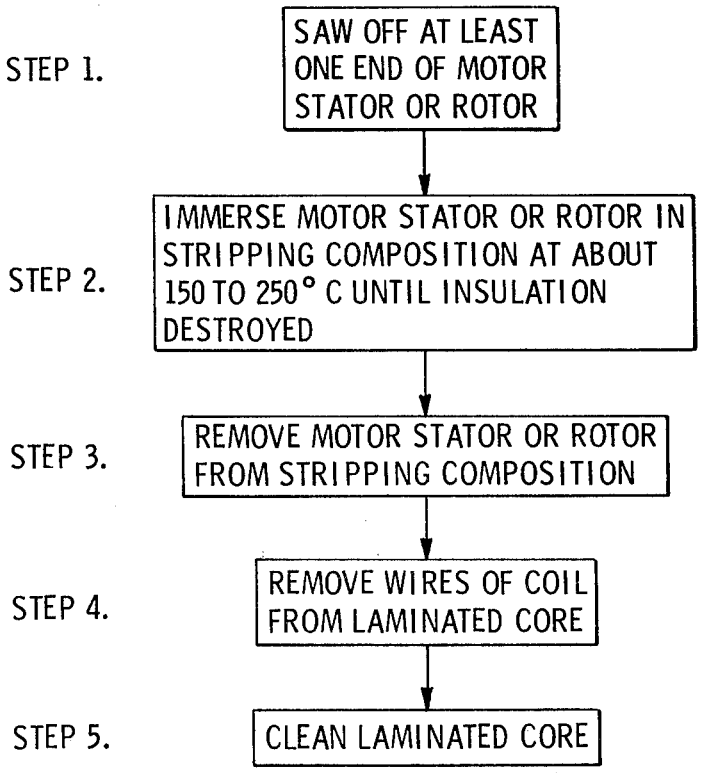
FIG. 2 is a flow chart of the process of this invention.

The stripped object is removed, drained, cooled, and washed with a solvent such as toluene, trichloroethylene, or perchloroethylene. For coils vapor degreasing is usually not adequate to remove all of the stripping composition from between the laminations, and leaching in a solvent is used as a supplemental cleaning step. FIG. 2 shows the steps involved in removing coils from a motor, stator or rotor using the process of this invention. In FIG. 2 steps 3 and 4 can be reversed.

While the composition was especially designed for stripping motors, it can also be used to strip generators, transformers, and other electrical conductors insulated with thermoset resins. The stripper can also be used on laminates to determine the amount of filler they contain, to clean objects contaminated with resins, or for other purposes.

Losses of the composition can occur due to entrainment on the object stripped, evaporation, oxidation, and reaction of the components with the resins. Therefore, from time to time the composition is renewed by replacing those components which have been lost or used up.

EXAMPLE 1

Stripper compositions were prepared and tested. The following table gives the compositions and the results of testing them on various thermoset laminates after 6 hours at 250° C.

| | Laminate | | | |
|---|---|---|---|---|
| Stripper | High temperature polyester | Epoxy cured with Dicyandiamide | Polyester | Phenolic |
| linseed oil fatty acid (LOFA) | Surface attack but no delamination | Laminate destroyed | Laminate destroyed | No attack |
| 100 pbw LOFA<br>50 pbw β-napthol | No Attack | Laminate destroyed | Slight attack | Slight attack |
| 100 pbw LOFA<br>50 pbw β-napthol<br>50 pbw triethylene glycol | Surface attack but no delamination | Laminate destroyed | Laminate destroyed | Laminate destroyed |
| 100 pbw tall oil<br>50 pbw β-napthol<br>50 pbw triethylene glycol | Laminate destroyed | Laminate destroyed | Laminate destroyed | Laminate destroyed |
| 100 pbw linseed oil<br>50 pbw β-napthol<br>50 pbw triethylene glycol | No attack | Laminate destroyed | Laminate destroyed | Laminate destroyed |
| 100 pbw tall pitch*<br>50 pbw resorcinol<br>50 pbw triethylene glycol | Laminate destroyed | Laminate destroyed | Laminate destroyed | Laminate destroyed |
| 100 pbw benzoic acid<br>50 pbw β-napthol<br>50 pbw triethy- | Laminate destroyed | Laminate destroyed | Laminate destroyed | Laminate destroyed |

-continued

| Stripper | Laminate: High temperature polyester | Epoxy cured with Dicyandiamide | Polyester | Phenolic |
|---|---|---|---|---|
| lene glycol | | | | |

*Sold by Union Camp under the trademark "Unitol DP" the composition of which is given as 45% fatty acids and esterified acids, 20% rosin acids, and 35% unsaponifiables The above table shows that while all of the strippers were able to destroy some of the laminates, only the fourth, sixth, and seventh compositions were able to destroy all of the laminates.

EXAMPLE 2

Based on the results of Example 1, a composition was prepared of 100 pbw tall oil, 50 pbw β-naphthol, and 50 pbw triethylene glycol. A number of different insulating materials were placed in this stripper at different temperatures and for different lengths of time. The following table gives the results:

| Material | Result |
|---|---|
| 10 mil resin treated glass cloth | destroyed in 10 min. at 175° C. |
| 15 mil mica board | resin dissolved within 6 hours at 250° C. |
| black varnish-treated asbestos | resin dissolved within 1 hour at 250° C. |
| varnished flexible mica | resin dissolved within 2 hours at 250° C. |
| silicone-varnished sleeving | resin dissolved within 1 hour at 250° C. |
| polyester glass bonding | resin dissolved within 4 hours at 250° C. |
| melamine laminate | destroyed within 6 hours at 250° C. |
| polyethylene terephthalate mat | dissolved within 4 hours at 250° C. |

EXAMPLE 3

The end turns of four stators having frame sizes 140 and one having frame size 215 were sawed off, and the stators were immersed in a composition at 250° C. of 25% β-naphthol, 25% triethylene glycol, and 50% tall pitch. Both stators used No. 61212 KA wire (polyester enamel with a nylon overcoat), a Nomex wedge and slot cell (an aromatic polyamide-imide paper sold by DuPont), and a Dacron/Mylar/Dacron phase (polyethylene terephthalate/polyimide/polyethylene terephthalate). The insulation systems of these stators was more complicated and resistant to solvent penetration than most commercial stators of this size. The following table gives the results.

| Sample | Frame Size | Other Insulation | Required Treatment Time (hrs) |
|---|---|---|---|
| 1 | 140 | One dip and bake in Westinghouse 32102 AJ varnish (a phenolic-alkyd); end turns brush coated with Epoxylite No. 213 (an epoxy) | 1.5 |
| 2 | 140 | Two dips and bake in Westinghouse 32102 AJ varnish | 1.5 |
| 3 | 140 | One dip and bake in Westinghouse 32102 AJ varnish; ends and base sprayed with DuPont #825-8031 Zn-chromate primer plus Cu-8; | 1.5 |

-continued

| Sample | Frame Size | Other Insulation | Required Treatment Time (hrs) |
|---|---|---|---|
| | | ends brushed with 32101 FA air dry varnish (an oil-modified phenolic resin) | |
| 4 | 140 | Trickle treated, Epoxylite No. 234 (≈150g epoxy resin) | 3 |
| 5 | 215 | Three times vacuum-pressure impregnated in GE 74011 solventless epoxy; end overcoated with Westinghouse 32102 AJ varnish; one coil per slot glass tape served | 3 |

The stators were removed from the stripping composition and the wires of the coils were easily removed mechanically. The laminated cores were cleaned in chloroform.

We claim as our invention:

1. A composition consisting essentially of:
(A) about 1 to about 99% of an aromatic compound which has a boiling point over 180° C. selected from the group consisting of aromatic phenols, aromatic primary amines, aromatic secondary amines, and mixtures thereof;
(B) about 1 to about 99% of a carboxylic acid compound selected from the group consisting of carboxylic acids, esters of carboxylic acids, and mixtures thereof, which has a boiling point over 180° C.; and
(C) sufficient hydrogen bonding compound to react with any acid present in said composition plus about 20 to about 50 phr (parts by weight per 100 parts of said aromatic compound plus said carboxylic acid compound) in excess of that amount, said hydrogen bonding compound having a boiling point over 180° C. and having at least one pair of unshared electrons capable of forming a hydrogen bond with said aromatic compound, said composition being a liquid at 150° C.

2. A composition according to claim 1 wherein said carboxylic acid compound is selected from the group consisting of rosin acids, fatty acids, esters thereof, and mixtures thereof.

3. A composition according to claim 1 wherein said aromatic compound, said carboxylic acid compound, and said composition each have a boiling point over 250° C.

4. A composition according to claim 1 wherein said carboxylic acid compound is tall pitch.

5. A composition according to claim 1 wherein said aromatic compound is a phenol.

6. A composition according to claim 5 wherein said phenol is selected from the group consisting of resorcinol, β-naphthol, and mixtures thereof.

7. A composition according to claim 1 wherein the concentration of said aromatic compound is about 10 to about 50% and the concentration of said carboxylic acid compound is about 50 to about 90%.

8. A composition according to claim 1 wherein said hydrogen bonding compound has a boiling point over 250° C. and has non-vicinal hydroxyl groups.

9. A composition according to claim 8 wherein said hydrogen bonding compound is triethylene glycol.

10. A composition according to claim 1 which includes up to about 50 phr of a swelling agent which has a boiling point over 180° C.

11. A composition according to claim 10 wherein the concentration of said swelling agent is about 5 to about 30 phr.

12. A method of removing thermoset resins from an article comprising immersing the article in a composition heated between about 150° and about 250° C. which consists essentially of:

(A) about 1 to about 99% of an aromatic compound which has a boiling point over 180° selected from the group consisting of aromatic phenols, aromatic primary amines, aromatic secondary amines, and mixtures thereof;

(B) about 1 to about 99% of a carboxylic acid compound selected from the group consisting of carboxylic acids, esters of carboxylic acids, and mixtures thereof, which has a boiling point over 180° C.; and (C) sufficient hydrogen bonding compound to react with any acid present in said composition plus about 20 to about 50 phr (parts by weight per 100 parts of said aromatic compound plus said carboxylic acid compound) in excess of that amount, said hydrogen bonding compound having a boiling point over 180° C. and having at least one pair of unshared electrons capable of forming a hydrogen bond with said aromatic compound, said composition being a liquid at 150° C.

13. A method according to claim 12 wherein said article is an electric motor.

14. A method of removing the coils from an electrical apparatus having coils of insulated wire embedded in a laminated core comprising:

(1) first, severing at least one end of said coils;

(2) second, immersing said apparatus in a composition heated between about 150° and about 250° C. which consists essentially of:

(A) about 1 to about 99% of an aromatic compound which has a boiling point over 180° C. selected from the group consisting of aromatic phenols, aromatic primary amines, aromatic secondary amines, and mixtures thereof;

(B) about 1 to about 99% of a carboxylic acid compound selected from the group consisting of carboxylic acids, esters of carboxylic acids, and mixtures thereof, which has a boiling point over 180° C.; and (C) sufficient hydrogen bonding compound to react with any acid present in said composition plus about 20 to about 50 phr (parts by weight per 100 parts of said aromatic compound plus said carboxylic acid compound) in excess of that amount, said hydrogen bonding compound having a boiling point over 180° C. and having at least one pair of unshared electrons capable of forming a hydrogen bond with said aromatic compound, said composition being a liquid at 150° C.;

(3) removing said laminated core from said composition after the insulation of said coils has been destroyed and removing the wire of said coils from said laminated core in either order; and (4) cleaning said laminated core.

15. A method according to claim 14 wherein said cleaning step comprises vapor degreasing followed by solvent leaching.

16. A method according to claim 14 wherein said carboxylic acid compound is selected from the group consisting of rosin acids, fatty acids, esters thereof, and mixtures thereof.

17. A method according to claim 14 wherein said aromatic compound, said carboxylic acid compound, and said composition each have a boiling point over 250° C.

18. A method according to claim 14 wherein said carboxylic acid compound is tall pitch.

19. A method according to claim 14 wherein said aromatic compound is a phenol.

20. A method according to claim 19 wherein said phenol is selected from the group consisting of resorcinol, $\beta$-naphthol, and mixtures thereof.

21. A method according to claim 14 wherein the concentration of said aromatic compound is about 10 to about 50% and the concentration of said carboxylic acid compound is about 50 to about 90%.

22. A method according to claim 14 wherein said hydrogen bonding compound has a boiling point over 250° C. and has nonvicinal hydroxyl groups.

23. A method according to claim 22 wherein said hydrogen bonding compound is triethylene glycol.

24. A method according to claim 14 wherein said composition includes up to about 50 phr of a swelling agent which has a boiling point over 180° C.

25. A method according to claim 24 wherein the concentration of said swelling agent is about 5 to about 30 phr.

* * * * *